US005682131A

United States Patent [19]

Gow

[11] Patent Number: 5,682,131

[45] Date of Patent: Oct. 28, 1997

[54] RETRACTABLE TAMPER RESISTANT ANNUNCIATOR

[76] Inventor: Thomas W. Gow, 1039 109th Ave. NW., Coon Rapids, Minn. 55448

[21] Appl. No.: 627,984

[22] Filed: Apr. 4, 1996

[51] Int. Cl.[6] ..... G08B 5/00

[52] U.S. Cl. ..... 340/286.11; 340/332; 340/691; 220/343; 49/2

[58] Field of Search ..... 340/286.11, 69.1, 340/332, 628; 49/2, 25, 31; 220/343, 260

[56] References Cited

U.S. PATENT DOCUMENTS

| | | | |
|---|---|---|---|
| 3,217,156 | 11/1965 | Sherwood | 240/10.6 |
| 3,324,304 | 6/1967 | Duncan . | |
| 3,659,179 | 4/1972 | Barker et al. . | |
| 3,860,829 | 1/1975 | Fabbri . | |
| 3,969,720 | 7/1976 | Nishino | 340/332 |
| 4,027,655 | 6/1977 | Feldl | 49/2 |
| 4,071,749 | 1/1978 | Balogh . | |
| 4,074,269 | 2/1978 | Hartley | 340/545 |
| 4,144,462 | 3/1979 | Sieron et al. . | |
| 4,216,410 | 8/1980 | Feldstein . | |
| 4,304,070 | 12/1981 | Musacchia | 49/2 |
| 4,405,923 | 9/1983 | Matsuoka et al. | 340/825.56 |
| 4,461,974 | 7/1984 | Chiu | 315/65 |
| 4,486,689 | 12/1984 | Davis et al. . | |
| 4,489,308 | 12/1984 | Logan, Jr. et al. | 340/691 |
| 4,518,896 | 5/1985 | Miles, Jr. | 315/162 |
| 4,571,531 | 2/1986 | Lin | 320/2 |
| 4,631,649 | 12/1986 | McCue et al. | 362/183 |
| 4,651,258 | 3/1987 | Davis et al. | 362/147 |
| 4,682,078 | 7/1987 | Pascalide | 315/86 |
| 4,708,223 | 11/1987 | Orndorff et al. | 187/1 R |
| 4,727,291 | 2/1988 | Bavaro | 315/86 |
| 4,802,065 | 1/1989 | Minter et al. | 362/20 |
| 4,862,147 | 8/1989 | Thomas | 340/628 |

*Primary Examiner*—Jeffery Hofsass
*Assistant Examiner*—John Tweel, Jr.
*Attorney, Agent, or Firm*—Nawrocki, Rooney & Sivertson, P.A.

[57] ABSTRACT

An improved retractable tamper resistant annunciator that can be mounted flush in a supporting structure is described. The annunciator mechanism includes a housing that has an actuatable cover. Signaling devices are enclosed within the housing, and can be selectively actuated when the cover is opened. A mechanism to open and close the cover to expose the signaling devices or to cover the signaling devices include a reversible motor structure. Alternative mechanisms to open and close the cover include biasing structures to move the cover in a first direction and an electrical device to move the cover in a second direction

18 Claims, 7 Drawing Sheets

RETRACTABLE TAMPER RESISTANT ANNUNCIATOR

BACKGROUND OF THE INVENTION

1. Field of the Invention.

This invention relates generally to electrically activated annunciators; and, more particularly it relates to an electrically activated annunciator that is retracted within a housing and is covered when not in operation to render it tamper resistant.

2. State of the Prior Art.

Various types of annunciators are known and in use for signaling a variety of situations. For example service buildings such as nursing homes and hospitals provide for signal lights in hallways that can be activated to signal that a condition exists or some form of service is necessary or required. Characteristically, these signal lights are mounted exposed on walls or in ceilings adjacent room entrances and are visible from a centralized observation location when lit. Such signal lights have controls that allow the light to be extinguished when the service is completed.

Electrically activated annunciators are also used in conjunction with alarms of various types. Such annunciators may involve sounding audio signals, such as sirens, horns, or audio warnings, as well as providing a light to indicate the signaled event. Signaled events can be various emergency alarms, for example such as the presence of fire, smoke, carbon monoxide, or the like. The visual signaling can be important in smoke or darkened conditions, and provide warning to hearing impaired. Controls for annunciators of this type are commonly wired into the structure, and commonly utilize a low power direct current distribution system.

Another class of electrically actuated annunciators involves signaling by audio transmission, or visual display, or both, of controlled events. For example, such annunciators are used in factories to provide notice of break time starting and ending, or to provide notice that some communication is about to occur, or the like. Again, these types of annunciator systems are characteristically wired into the structure and are subject to activation and deactivation from one or more control points.

The prior art electrically activated annunciators are usually mounted in some exposed location and are subject to accidental damage, intentional vandalism, collection of dirt and grime, and in many cases are not aesthetically pleasing to look at.

To address the deficiencies in the prior art, this retractable tamper resistant annunciator was developed to provide an annunciator than can be used in new construction. The improved annunciator can also be readily used in remodelling or in retrofit circumstances to provide an aesthetically pleasing structure that can be mounted flush in a ceiling or a wall. The annunciator mechanism includes a housing that has a cover, wherein the cover is automatically opened when the annunciator is activated, and remains open while the signaling device(s) remain activated. With deactivation of the signaling device(s), the annunciator operation can be deactivated, and the cover closed to protect and hide the internal annunciator mechanisms.

Other and more detailed objectives of the invention will become apparent from a consideration of the drawings and the following description of the invention.

SUMMARY OF THE INVENTION

The present invention includes an electrically actuatable annunciator that has a housing structure with a movable cover structure to enclose and to selectively expose a signaling device when the annunciator is activated. The cover structure is hingedly mounted to the housing structure and has one or more signaling devices mounted to the underside thereof. When the cover structure is closed the signaling device or devices are enclosed within the housing structure and are not visible. When the cover structure is opened the signaling device or devices are exposed and available for operation.

An electrically actuatable activation mechanism is mounted within the housing structure and is coupled to the cover structure in a manner that causes the cover structure to be opened when it receives an activation signal. Once the cover structure is opened, the signaling device or devices can be activated. When the signaling event is completed, the signaling device or devices can be turned off. A deactivation mechanism responds to a deactivation signal to cause the cover structure to be closed.

The system for activating and deactivating the annunciator has an improved direct current drive motor that will rotate its shaft in a first direction when a first electrical signal is applied and in the opposite direction when a second electrical signal is applied. The motor has a bell crank connected to its shaft for opening and closing the associated cover when the shaft is rotated in either the first or second directions. The shaft also has a switch actuator affixed in a manner to cooperate with two separate limit switches, so that when the shaft turns to a fixed position in the first direction, the first limit switch is contacted by the switch actuator and opens the drive circuit. This limits the movement of the bell crank in the first direction, and thereby limits the movement of the cover. When the shaft moves in the second direction, the switch actuator comes in contact with the second limit switch and thereby limits the movement of the shaft and the bell crank such that the movement of the cover is also limited in the second direction. Alternative bias mechanisms and solenoid activation and deactivation circuits are provided.

The present invention is thus an improved electrically actuatable annunciator that is fitted within a housing that can be mounted within a wall or ceiling, wherein the housing has a predetermined aperture and a hingedly mounted cover that can be opened and closed by application of electrical signals. When activated, the annunciator cover is opened and the signaling device or devices can be exposed for operation. When deactivated, the annunciator signaling devices are disabled from further operation, and the cover is closed to thereby enclose and protect the annunciator apparatus. Additional features of the invention and the advantages derived therefrom, and the various scopes and aspects of the invention will become apparent from the drawings, the description of the preferred embodiment of the invention, and the claims.

DESCRIPTION OF THE PREFERRED EMBODIMENT

Figure 1:
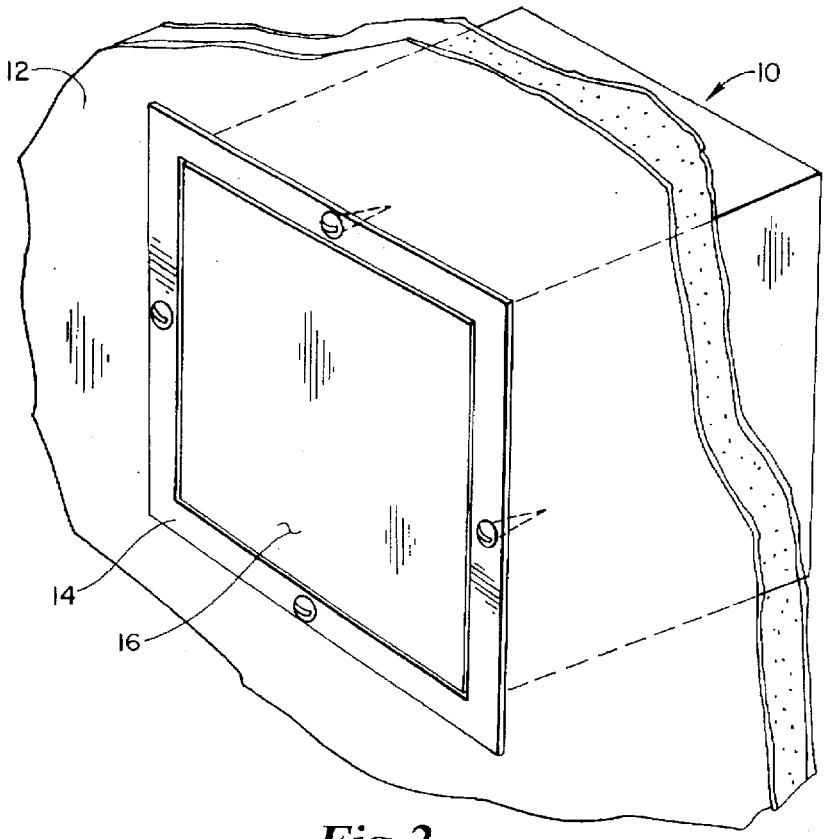
FIG. 1 is a fragmentary perspective view of the improved annunciator mounted in a wall structure with the cover closed and awaiting activation.

When referring to the drawings, like reference numerals will denote like elements throughout the various views.

FIG. 1 is a fragmentary perspective view of the improved annunciator mounted in a wall structure with the cover closed and awaiting activation. The annunciator 10 is mounted flush with wall 12 by mounting ring 14. Cover 16 is shown closed, and of a generally rectangular shape. It is of course understood that the over-all shape of the annunciator and the shape of the cover can be altered to accommodate various construction structures, and aesthetic requirements. The configuration illustrated has been found to be particularly advantageous for use in framed construction structures.

Figure 2:
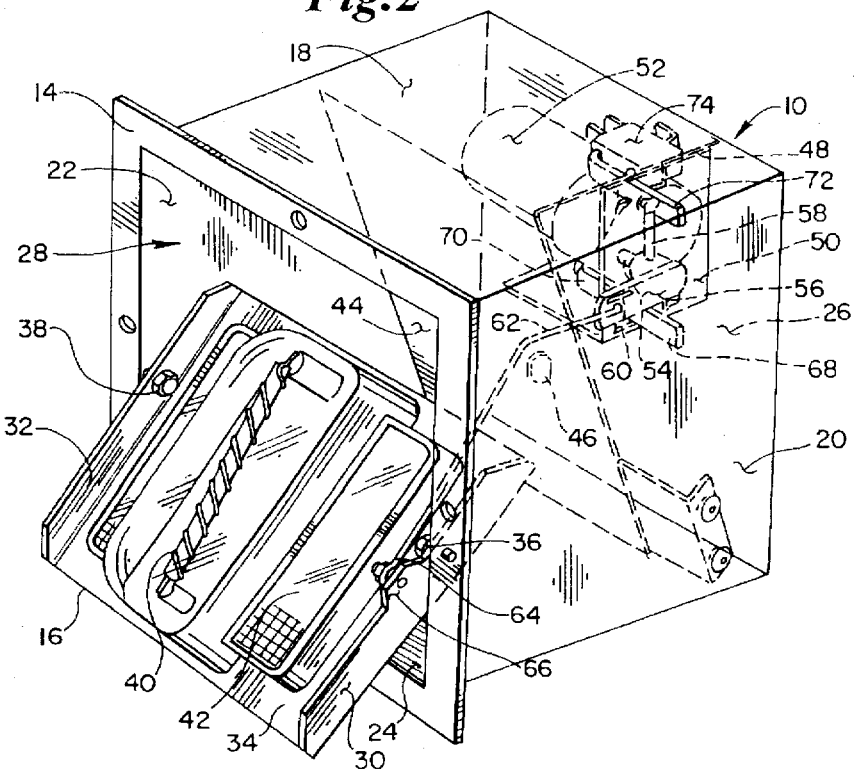
FIG.2 is a perspective view of the improved annunciator with cover opened and the signaling devices deployed for operation.

FIG. 2 is a perspective view of the improved annunciator with the cover opened and the signaling devices deployed for operation. Annunciator 10 has a top 18, opposed sides 20 and 22, a bottom 24, a back 26, and an opening aperture 28. The shape of cover 16 is adapted to match the shape of opening aperture 28. Support structures 30 and 32 are disposed at the opposed sides of bottom surface 34 of cover 16. Cover 16 is hingedly mounted to side walls 20 and 22 by couplings 36 and 38, respectively, through support structures 30 and 32, respectively. As shown, couplings 36 and 38 are off-set on support structures 30 and 32.

A selectively actuatable signaling light 40, such as a strobe light, and an audio device 42, such as a siren sounder, are mounted to surface 34, and are exposed for operation when cover 16 is opened. It is of course understood that in some uses one or the other might be omitted, and that other signaling devices might be employed to meet the needs of any particular annunciating requirements. Power and control circuits are not shown in FIG. 2, but will be described below.

An inner plate 44 is arranged at a predetermined angle between bottom 24 and top 18, and is situated between sides 20 and 22. A wiring aperture 46 is formed in plate 44. Plate 44 an upper member 48 at an angle to plate 44 and situated in proximity to top 18. Downwardly extending member 50 is supported by upper member 48, and is utilized to support motor 52. Motor 52 is a geared direct current motor that has a shaft 54 to which a bell crank 56 is attached. Shaft 54 also has a switch actuator 58 attached to it in a predetermined angular relationship to bell crank 56.

Bell crank 56 has its crank end coupled to one end 60 of drive rod 62. Drive rod 62 has its other end 64 rotatably coupled to lip 64 of support structure 30, where lip 64 is off-set from hinge mounting 36.

Switch actuator 58 is arranged to cooperate with blade 68 of limit switch LS1, labelled 70, when shaft 54 is rotated to a first cover closed position, and to cooperate with blade 72 of limit switch LS2, labelled 74, when shaft 54 is rotated to a second cover open position. These operations will be described in more detail below.

Figure 3:
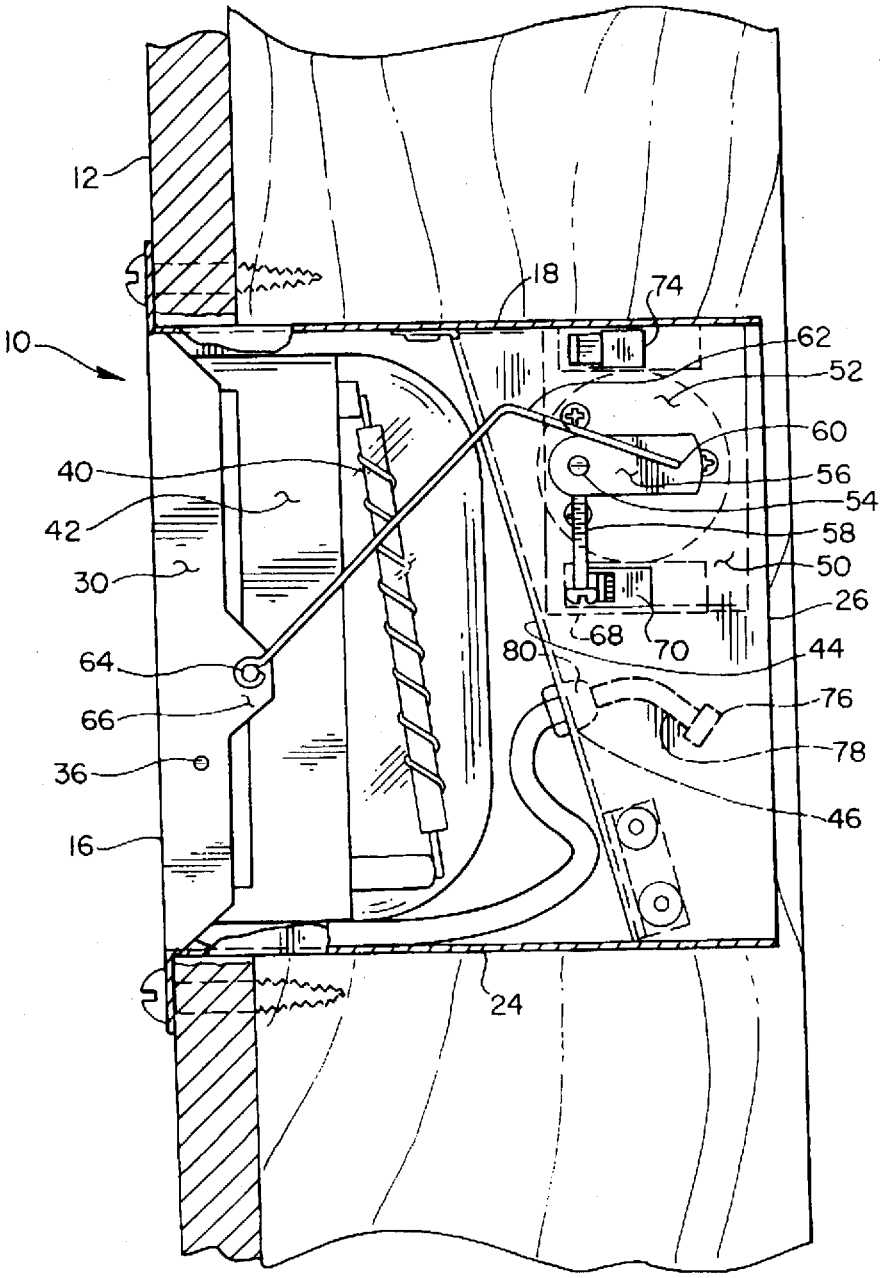
FIG. 3 is a side elevation view of the invention as shown in FIG. 1, with parts broken away.

FIG. 3 is a side elevation view of the invention as shown in FIG. 1 with parts broken away. This view represents the improved annunciator 10 in the deactivated condition with cover 16 in the closed position, thereby placing the visual indicator or signaling light 40 and audio device 42 within the confines of the annunciator housing. Switch actuator 58 is in contact with the blade 68 of limit switch 70, thereby deactivating the closure of cover 16. In this position bell crank 56 has caused drive rod 62 to rotate cover 16 around hinges 36 and 38 to the closed position.

Power is provided to signaling light 40 and audio device 42 through connector 76 and conductor cable 78. Cable 78 passes through aperture 46 and is held in place by grommet 80, with flexible portion 78' of cable 78 coupled to signaling light 40 and audio device 42. Power levels and control of motor 52 will be described in detail below.

Figure 4:
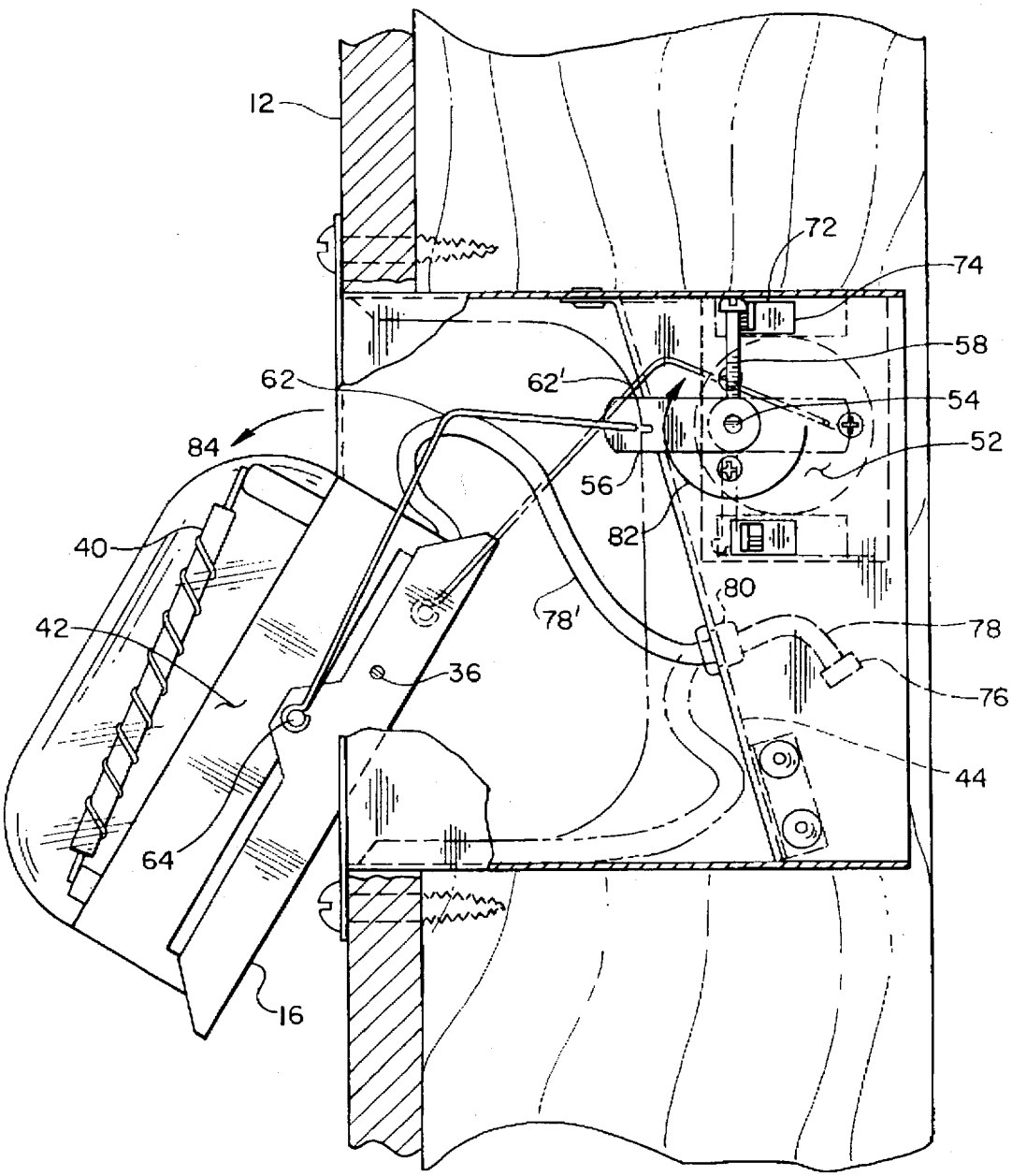
FIG. 4 is a side elevation view of the invention as shown in FIG. 2, with parts broken away.

FIG. 4 is a side elevation view of the invention as shown in FIG. 2 with parts broken away. As shown, cover 16 has been opened exposing signaling light 40 and audio device 42 for operation. Operation of motor 52 causes shaft 54 to rotate bell crank 56 in the direction of arrow 82. Bell crank 56 movement causes drive rod 62 to move from the rest position, shown dashed as drive rod 62', to the open position by rotating cover 16 around hinges 36 and 38, as shown by arrow 84. Cable portion 78' flexes as cover 16 is opened.

When motor 52 has rotated shaft 54 sufficiently, the switch actuator 58 will come in contact with blade 72 of limit switch 74, and will thereby open the associated circuit to thereby discontinue operation of motor 52, as will be described in detail below.

FIG. 3 and FIG. 4 have illustrated the annunciator 10 mounted in a wall 12 with cover 16 opening outwardly from the top. It is understood that annunciator 10 could equally as well be used in the reversed position to open cover 16 outwardly from the bottom, or it could be utilized in any other desired positioning on a wall or in a ceiling to thereby provide improved visibility or sound transmission.

Figure 5:
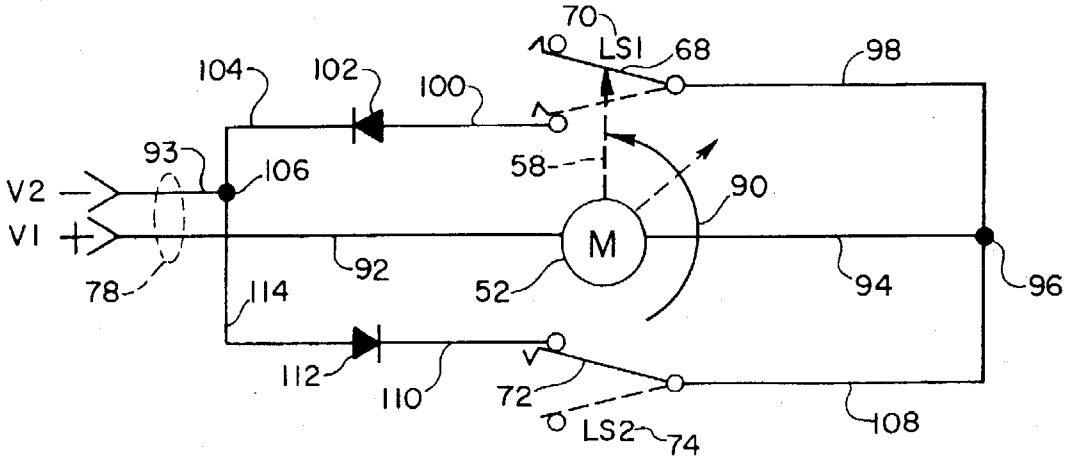
FIG. 5 is a simplified circuit diagram of the deactivation mechanism to position the cover and the signaling devices in the positions of FIG. 1 and FIG. 3.

FIG. 5 is a simplified circuit diagram of the deactivation mechanism to position the cover and the signaling devices in the positions of FIG. 1 and FIG. 3. This circuit illustrates the operation to cause motor 52 to move switch actuator 58 in the direction of arrow 90. In the preferred embodiment motor 52 is available commercially and functions to rotate in either of two directions depending upon the polarity of applied dc voltage. While it is understood that various dc voltages can be utilized, it has been determined that 24 volts dc provides adequate power, and is commonly used in low power supplies used in buildings for various control systems. Low voltage direct current sources are often used in building distribution systems because of safety considerations, and because it can be readily backed up with battery reserves such that operation of circuitry can be readily assured even in the event of loss of normally supplied utility power. Since annunciators are often required to operate in periods of emergency, it is necessary to utilize a power supply that is not easily interruptible.

To close cover 16, voltage V1, such as 24 volts dc, is applied to line 92 and voltage V2, such as 0 volts dc (ground potential) is applied to line 93. Other voltages can be used, it being understood that to close the cover, it is necessary only that voltage V1 be sufficiently greater than voltage V2 to cause operation of motor 52. Positive power is applied through motor 52 to line 94 and node 96. Thereafter, power is applied over line 98 through normally-closed contact of limit switch (LS1) 70 to line 100. Diode 102 is coupled to line 100 and line 104, and line 104 is coupled to node 106.

Diode 102 operates in manner such that it will conduct current only when the voltage applied on line 100 is more positive than the voltage applied at node 106. Thus, with V1 at 24 volts de and V2 at 0 volts dc, current will pass through motor 52, limit switch 70 and diode 102 until motor 52 causes switch actuator 58 to contact the blade 68 of LS1 causing it to open the circuit and thereby causes motor 52 to be deactivated.

When being activated to close cover 16, the positive potential at node 96 is also applied over line 108 to normally closed limit switch LS2 72 and to line 110. Diode 112 is coupled between line 110 and line 114, with line 114 coupled to node 106. Diode 112 will only conduct current if the voltage at node 106 is greater than the voltage at node 96. Since V2 is 0 volts dc this example, node 106 is at a lower potential than the potential at node 96, and diode 112 will block any current flow through limit switch LS2 74.

Figure 6:
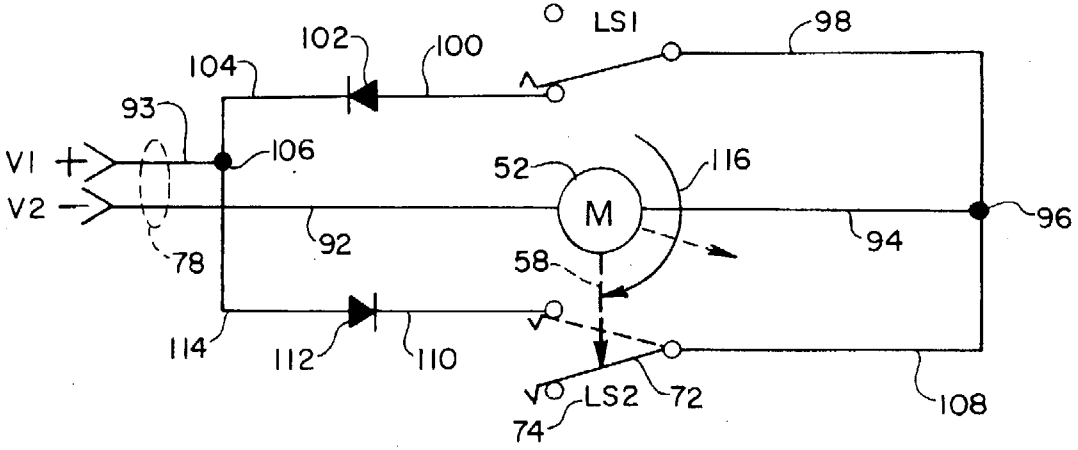
FIG. 6 is a simplified circuit diagram of the activation mechanism to position the cover and signaling devices in the positions of FIG. 2 and FIG. 4.

FIG. 6 is a simplified circuit diagram of the activation mechanism to position the cover and signaling devices in the positions of FIG. 2 and FIG. 4. This is the same circuit illustrated in FIG. 5, with the exception that the polarities of voltages V1 and V2 are reversed. Means for reversal of the polarities will be described below. With V1 of 24 volts dc applied via line 93 to node 106 and V2 of 0 volts dc applied to line 92, diode 112 will pass current through normally-closed limit switch 74 and apply V1 to node 96. With V1 at node 96 and V2 at line 92, motor 52 will be activated to rotate its shaft in the direction of arrow 116, thereby causing switch actuator 58 to come in contact with blade 72 to open LS2. Once LS2 is opened, power is no longer applied to motor 52 and it ceases to rotate with cover 16 opened.

At the same time V1 of 24 volts dc at node 93 and substantially V2 of 0 volts dc at node 96 (it being 0 volts dc plus the voltage drop across motor 52) biases diode 102 such that it blocks current flow. The upper circuit is inoperative during opening of cover 16 in the same manner as the lower circuit is inoperative during the closing of cover 16, as described above.

Figure 7:
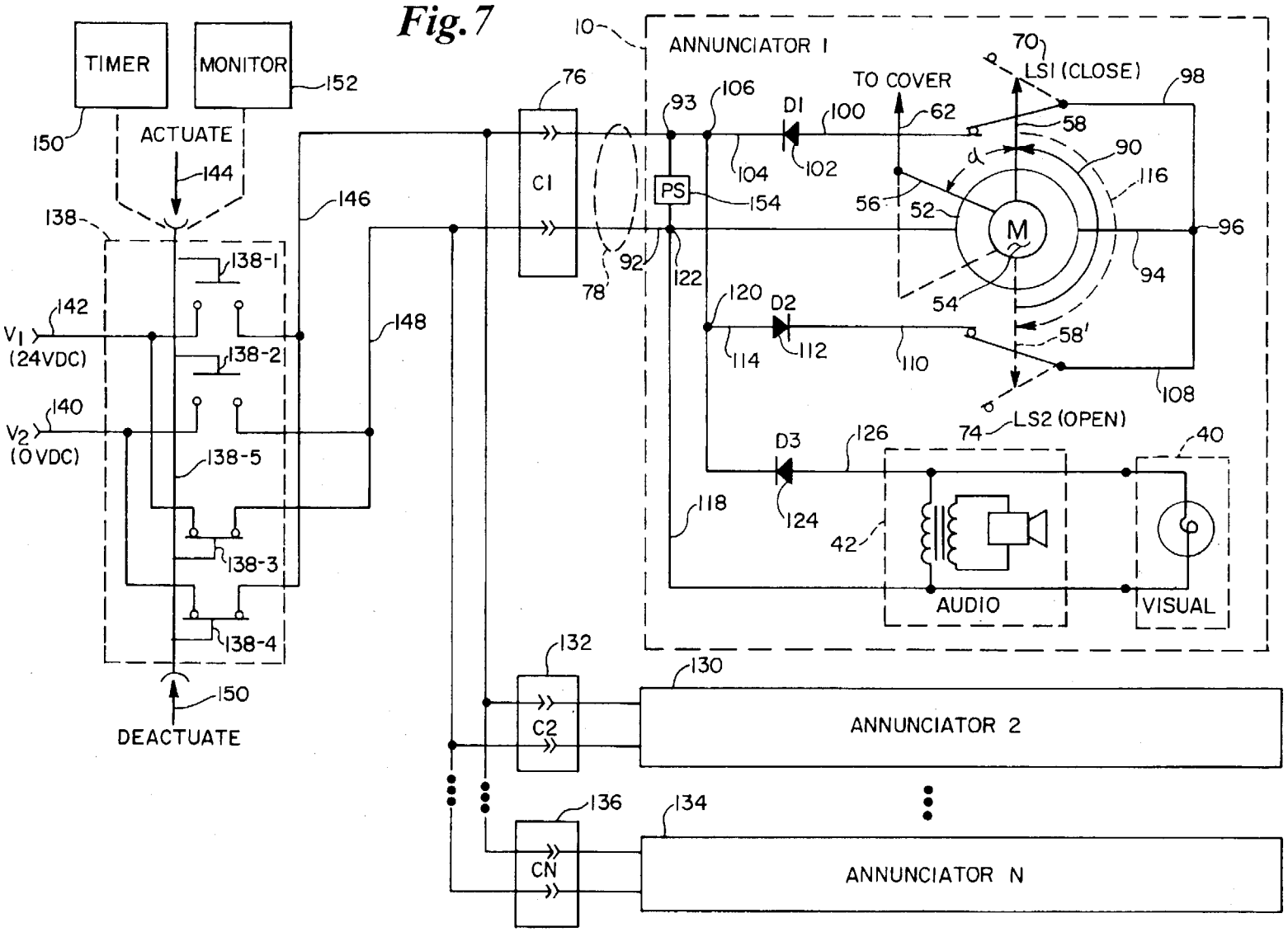
FIG. 7 is a simplified circuit diagram of a plurality of the improved annunciators of the present invention coupled to a centralized control circuit.

FIG. 7 is a simplified circuit diagram of a plurality of the improved annunciators of the present invention coupled to a centralized control structure. The annunciator shown within dashed block 10 includes the motor 52 operational control circuitry as described with reference to FIG. 5 and FIG. 6 for closing and opening cover 16, along with a visual signaling device shown in dashed block 40 and an audio signaling device shown in dashed block 42. It is of course understood that different signaling devices might equally as well be used, and that in some cases one or the other of devices 40 and 42 might not be used.

Power for signaling devices 40 and 42 is derived from lines 116 and 118, which are coupled to nodes 120 and 122, respectively. Diode D3, labelled 124, coupled between lines 116 and 126 with its polarity such that a voltage on line 116 that is higher than the voltage on 126 will inhibit current flow and audio device 42 and visual device 40 will be deactivated. This is the same circuit condition that causes the cover to be closed, as described with respect to FIG. 5. Similarly, if the voltage applied to line 116 is at a lower level than the voltage on line 126, diode D3 will be biased to conduct current, and devices 40 and 42 will be provided power to operate. This latter circuit condition occurs when the cover activating circuitry is such that the cover will be opened, as described above with respect to FIG. 6.

Switch actuator 58 is mounted on shaft 54 at a predetermined angle "a" to bell crank 56, which in turn drives rod 62 for moving the cover. The angle "a" can be selected to cause the desired movement of cover 16 in response to the rotation of shaft 54. In the preferred embodiment angle "a" is approximately ninety degrees.

Annunciator 2 labelled 130 has power provided through connector C2 labelled 132, and annunciator N labelled 134 has power provided through connector CN labelled 136. There can of course be as many annunciators in the system as required, and each annunciator can have the type of signaling device required for the location.

Power is provided to the annunciators through a cross-bar switch arrangement shown in dashed block 138. In this illustrative arrangement dc power is applied with voltage V1 on line 140 and voltage V2 on line 142, where V1 is nominally 24 volts dc and V2 is 0 volts or ground. Cross-bar switch 138 is comprised of two pairs of associated contacts labelled 138-1, 138-2, 138-3, and 138-4. Actuator 138-5 is operative to close contacts 138-1 and 138-2 when moved in the direction of arrow 144, and at the same time open contacts 138-3 and 138-4. Closing contact 138-1 puts voltage V1 (24 vdc) on line 146, and closing contact 138-2 puts voltage V2 (0 vdc) on line 148. As described above, this voltage arrangement will cause motor 52 to move switch actuator in the direction of dashed arrow 116 to a position marked 58' to open LS2, cover 16 is opened, and signaling devices 40 and 42 are operative. This operation will continue until actuator 138-5 is moved to the deactuate position by moving it in the direction of arrow 150. This movement will cause contacts 138-1 and 138-2 to be opened and causes contacts 138-3 and 138-4 to be closed, thereby applying voltage V1 (24 vdc) on line 148 and applying voltage V2 (0 vdc) on line 146. As described, applying V1 and V2 in this fashion causes the signaling devices 40 and 42 to be deactivated, and causes motor 52 to move the switch actuator 58 in the direction of arrow 90 until LS1 is opened. At that time the cover 16 is closed.

The activation and deactivation of the cross-bar switch 138 can be accomplished manually; by timers, such as shown by timer 150; or by monitors, such as monitor 152. Monitors may include sensors at various locations that sense such conditions as fire, smoke, carbon monoxide, chemical spills, intrusion, proximity of monitored objects, power failure, or any other characteristic that is monitored that requires signaling of the monitored characteristic. Of course by adding proper isolation circuits (not shown), various combinations of activation/deactivation can be used to actuate and deactuate the annunciators.

Optionally, a power sensor PS labelled 156 can be coupled across lines 92 and 93 to provide an indication that power is available. This indication can be an indicating light that is mounted either in cover 16 or in mounting ring 14 in a manner that makes it observable when the cover 16 is closed.

Figure 8:
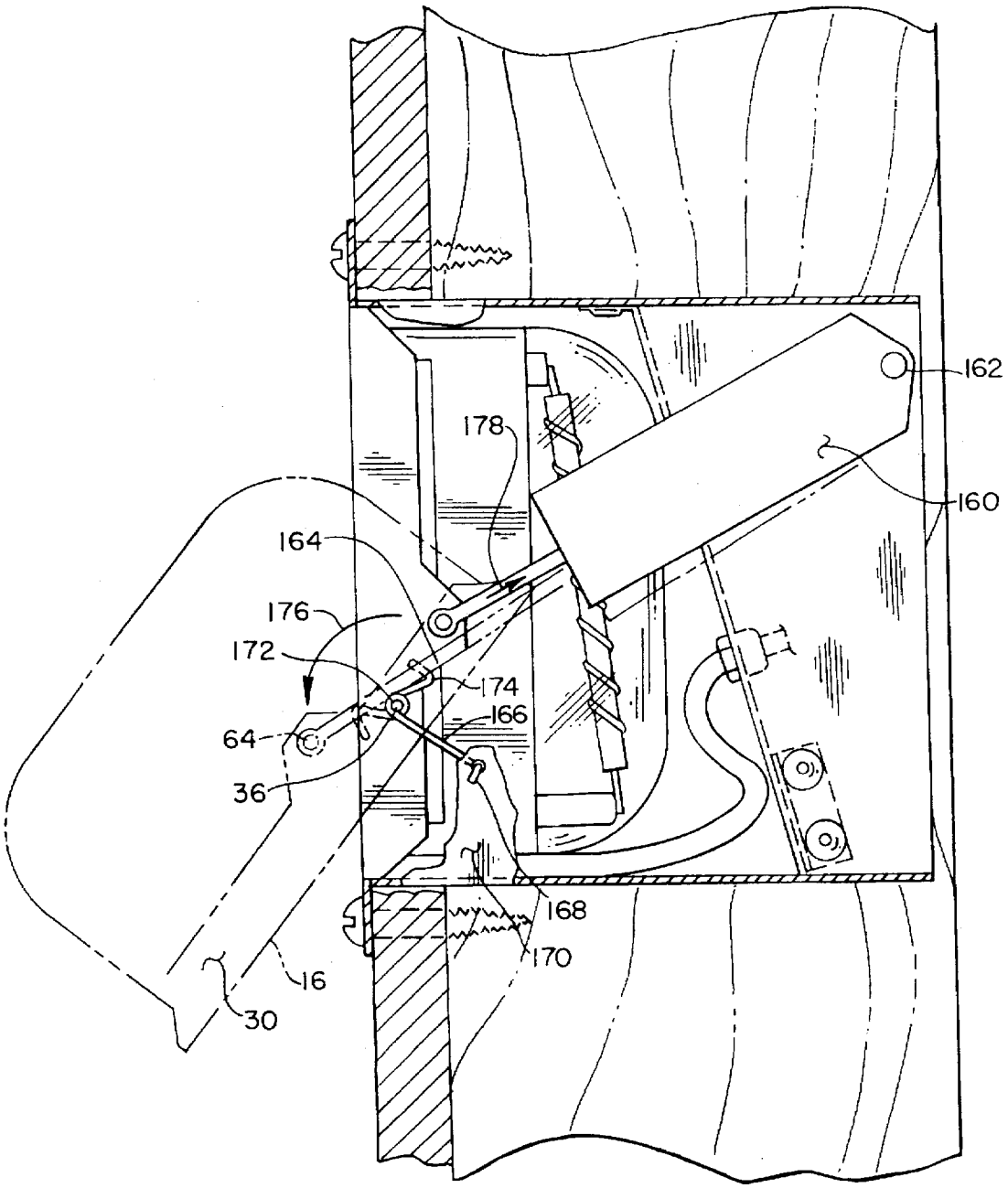
FIG. 8 is a first alternate embodiment of a biasing and solenoid mechanism for controlling operation of the cover.

FIG. 8 is a first alternate embodiment of a biasing and solenoid mechanism for controlling operation of the cover. In this arrangement solenoid 160 has one end 162 pivotally mounted inside the housing and its plunger 164 connected at pivot point 64. A spring 166 has one end 168 retained by mount 170. Portion 172 is a coil at drive point 36, and end 174 is coupled to engage side member 30. Spring 166 is under tension when cover 16 is closed, such that when cover 16 is released, spring 166 will cause the cover 16 to open in the direction of arrow 176. When the annunciator is to be deactivated and cover 16 closed, power is applied to solenoid 160 causing its plunger to be withdrawn in the direction of arrow 178. In this embodiment the spring bias is to open the cover and the electrical operation of the closing solenoid closes the cover.

Figure 9:
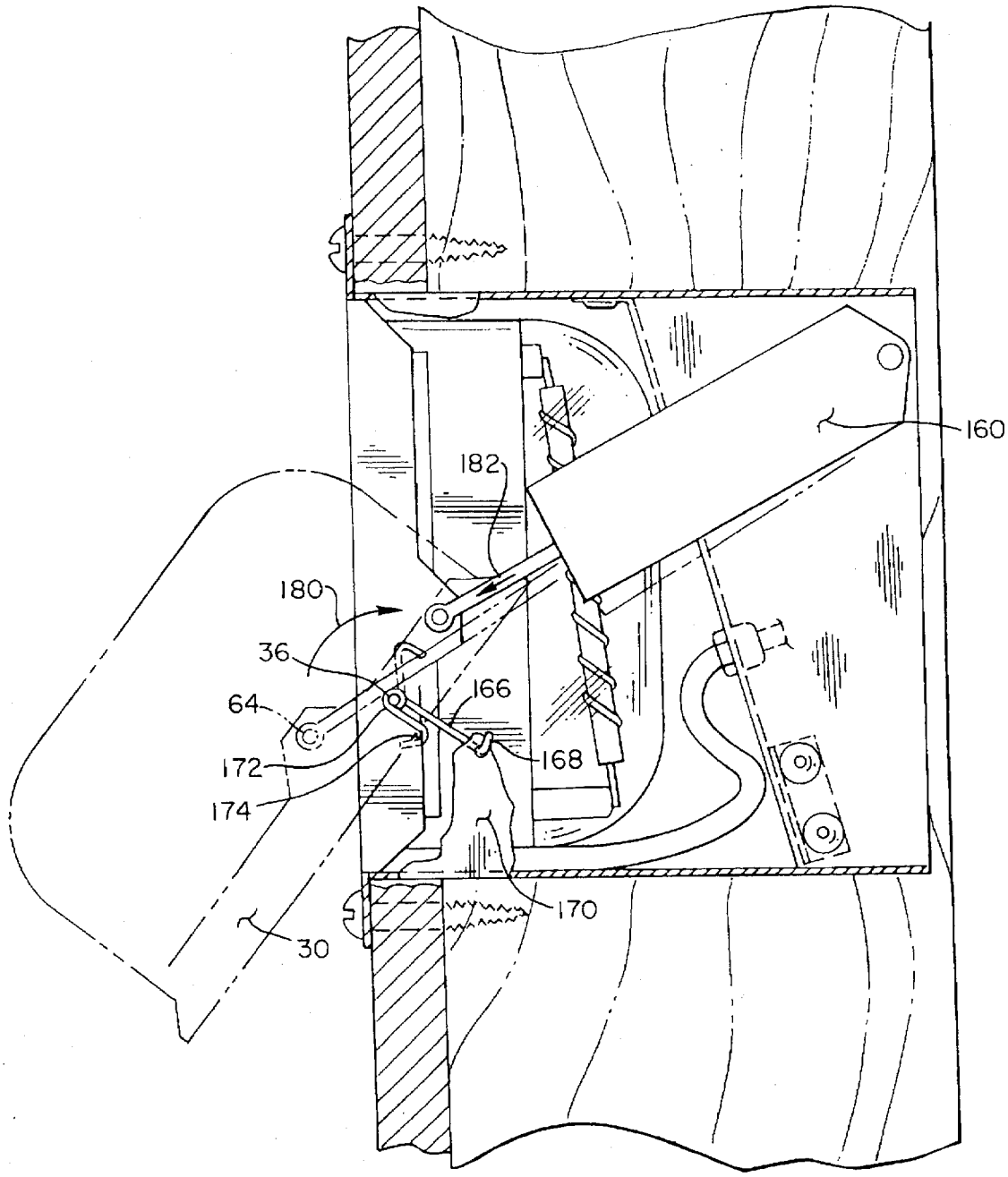
FIG. 9 is a second alternate embodiment of a biasing and solenoid mechanism for controlling operation of the cover.

FIG. 9 is a second alternate embodiment of a biasing and solenoid mechanism for controlling operation of the cover. In this arrangement solenoid 160 is mounted as described above. Spring 166 is similarly mounted at end 168 to mount 170. The spiral portion 172 is reversed at pivot point 36, with end 174 engaging member 30 between pivot points 36 and 64, thereby biasing movement of cover 16 in the direction of arrow 180. In operation then, when solenoid 160 is activated, it moves its plunger in the direction of arrow 182. This overcomes the bias of spring 166 and cover 16 is opened under control of the electrical circuit. When power is removed from solenoid 160, the coiled action of spring 166 causes the cover to move in the direction of arrow 180 to close the cover.

It can be seen from the foregoing description of the preferred embodiment and the operation thereof, that the objectives of providing an improved retractable tamper resistant annunciator has been achieved. The annunciator system allows mounting flush within a mounting structure, and provides a closure in which signaling devices are safely retained when not actuated. An actuatable cover can be opened under control of a control mechanism to thereby expose the signaling devices for operation. When signaling has been completed, the cover can again be closed cover the signaling devices.

Numerous characteristics and advantages of the invention have been set forth. It is understood that the description of the preferred embodiment is, in many respects, only illustrative. Changes may be made in details, particularly in matters of shape, size, and arrangement of parts without departing from the scope of the invention. Having described the preferred embodiment in conjunction with the drawings, it can be seen that the various purposes and objectives have been achieved, and that there are modifications and extensions that will become apparent to those skilled in the art without exceeding the spirit and scope of the invention. Accordingly, what is intended to be protected by Letters Patent is set forth in the appended claims.

What is claimed is:

1. An improved signal responsive annunciator comprising:

a housing structure having a predetermined opening therein;

a cover structure movably mounted to said housing structure to substantially close said predetermined opening;

a signaling device positioned within said housing structure;

an activation mechanism mounted in said housing structure and interconnected to said cover structure, said activation mechanism including an activation input circuit to receive activation signals; and a deactivation mechanism mounted in said housing structure and interconnected to said cover structure, said deactivation mechanism including a deactivation input circuit to receive deactivation signals;

whereby received activation and deactivation signals cause said activation mechanism and said deactivation mechanism, respectively, to open and close, respectively, said cover structure;

wherein said activation mechanism and said deactivation mechanism includes a motor coupled to said activation input circuit and to said deactivation input circuit, said motor having a shaft turning in a first direction in response to received activation signals and turning in a second direction in response to received deactivation signals to thereby open and close said cover structure; and wherein said activation mechanism and said deactivation mechanism includes a bell crank having a mounting end coupled to said shaft and a crank end, and an activation rod having a first end coupled to said crank end and having a second end coupled to said cover structure.

2. An annunciator as in claim 1, wherein said activation mechanism further includes:

a circuit coupling said signaling device to said activation input circuit, whereby received activation signals activate said signaling device.

3. An annunciator as in claim 1, wherein said deactivation mechanism further includes:

a circuit coupling said signaling device to said deactivation input circuit, whereby received deactivation signals deactivate said signaling device.

4. An annunciator as in claim 1, and further including a first rotation control structure to limit the extent of rotation of said shaft in a first direction; and a second rotation control structure for limiting the extent of rotation of said shaft in a second direction.

5. An annunciator as in claim 4, wherein said first rotation control structure includes a first limit switch mounted in a first predetermined position with respect to said shaft;

said second rotation control structure includes a second limit switch mounted in a second predetermined position with respect to said shaft; and a limit switch actuator mounted to said shaft to selectively actuate said first limit switch to limit rotation of said shaft in said first direction and to selectively actuate said second limit switch to limit rotation of said shaft in said second direction.

6. An annunciator as in claim 1, wherein said activation mechanism includes a biasing device biasing said cover structure toward the open position.

7. An annunciator as in claim 6, wherein said biasing device is a spring.

8. An annunciator as in claim 6, wherein said deactivation mechanism includes a solenoid coupled to said cover structure and is operable to close said cover structure in response to deactivation signals.

9. An annunciator as in claim 1, wherein said deactivation mechanism includes a biasing device coupled to said cover structure biasing said cover structure toward a closed position on said housing structure; and said activation mechanism includes a solenoid coupled to said cover structure and is operable to open said cover structure in response to activation signals.

10. An annunciator as in claim 1, wherein said signaling device includes a light source mounted to be visible when said cover structure is opened.

11. An annunciator as in claim 1, wherein said signaling device includes an audio sounding device mounted to be capable of being heard when said cover structure is opened.

12. An improved annunciator system comprising:

a plurality of annunciator means each for mounting at a selected location in a structure, each of said plurality of annunciator means including a. housing means for mounting in an associated support structure, said housing means including an aperture;

b. cover means for covering said aperture;

c. signaling means enclosed within said housing means;

d. input means for alternatively receiving first and second power signal; and e. cover opening and closing means for selectively opening said cover means and activating said signaling means in response to a first combination of said power signals and for selectively deactivating said signaling means and for closing said cover means in response to a second combination of said power signals;

power input means for coupling to a source of power and for providing said first and second power signals; and switching means coupled to said power input means and to said input means of each of said plurality of annunciator means, said switching means for selectively applying said first combination of power signals for opening said cover means and activating said signaling means and alternatively applying said second combination of power signals for deactivating said signaling means and for closing said cover means.

13. An annunciator as in claim 12, and further including sensing means coupled to said switching means for activating and deactivating said switching means in response to predetermined sensed conditions.

14. For use in an improved tamper resistant annunciator having a housing with an aperture therein, a movable cover to open and close the aperture, and a signaling device enclosed within the housing and visible when the cover is opened, and improved cover moving mechanism comprising:

an input circuit of alternatively receiving first power signals and second power signals;

a reversible drive apparatus coupled to said input circuit and coupled to the cover to move the cover to a first position in response to said first power signals and to move the cover to a second position in response to said second power signals; and a signaling circuit coupled to said input circuit to activate the signaling device in response to said first power signals and to deactivate the signaling device in response to said second power signals.

15. A cover moving mechanism as in claim 14, wherein said reversible drive apparatus includes a motor having a shaft rotatable in a first direction in response to said first power signals and rotatable in a second direction in response to said second power signals;

a first motor drive circuit coupled to said motor and to said input circuit for applying said first power signals to said motor; and a second motor drive circuit coupled to said motor and to said input circuit for applying said second power signals to said motor.

16. A cover moving mechanism as in claim 15, wherein said first motor drive circuit includes a first diode circuit for passing current through said motor in a first direction in response to said first power signals; and said second motor drive circuit includes a second diode circuit for passing current through said motor in a second direction in response to said second power signals.

17. A cover moving mechanism as in claim 16, and further including a bell crank having a mounting end coupled to said shaft and a crank end; and an activation rod coupled to said crank end and having a cover engaging end.

18. A cover moving mechanism as in claim 17, wherein said first motor drive circuit includes a first limit switch mounted in a first predetermined position with respect to said shaft;

said second motor drive circuit includes a second limit switch mounted in a second predetermined position with respect to said shaft; and a limit switch actuator mounted to said shaft in a predetermined relationship to said bell crank, said limit switch actuator arranged to selectively actuate said first limit switch to limit rotation of said shaft in said first direction and to selectively actuate said second limit switch to limit rotation of said shaft in said second direction.

* * * * *